US007667138B2

(12) United States Patent
Koga

(10) Patent No.: US 7,667,138 B2
(45) Date of Patent: Feb. 23, 2010

(54) ELECTRONIC APPARATUS WITH FLEXIBLE FLAT CABLE FOR HIGH-SPEED SIGNAL TRANSMISSION

(75) Inventor: Yuichi Koga, Hachioji (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 149 days.

(21) Appl. No.: 12/045,445

(22) Filed: Mar. 10, 2008

(65) Prior Publication Data

US 2008/0236868 A1 Oct. 2, 2008

(30) Foreign Application Priority Data

Mar. 28, 2007 (JP) ..... 2007-084279

(51) Int. Cl.
*H01B 7/00* (2006.01)

(52) U.S. Cl. ..... 174/110 R; 174/113 R; 174/117 F; 174/117 FF

(58) Field of Classification Search ..... 174/110 R, 174/113 R, 117 R, 117 F, 117 FF, 74 R, 84 R, 174/88 C; 29/828, 825
See application file for complete search history.

(56) References Cited

U.S. PATENT DOCUMENTS 5,940,963 A * 8/1999 Tolmie et al. ..... 29/828
6,148,510 A * 11/2000 Yokoi et al. ..... 29/828
6,326,549 B1 * 12/2001 Kunii et al. ..... 174/88 C
6,631,554 B1 * 10/2003 Sato et al. ..... 29/828

FOREIGN PATENT DOCUMENTS

| | | |
|---|---|---|
| JP | 3096395 | 6/2003 |
| JP | 2003217360 | 7/2003 |
| JP | 11353953 | 3/2008 |

* cited by examiner

*Primary Examiner*—William H Mayo, III
(74) *Attorney, Agent, or Firm*—Blakely, Sokoloff, Taylor & Zafman LLP

(57) ABSTRACT

According to one embodiment, a flexible flat cable includes a plurality of ground lines and a plurality of signal lines. Each of the ground lines is connected to an electromagnetic shield layer by two connection line members. An arrangement of the ground lines and signal lines that are positioned in a region on one side of a center line of the flexible flat cable and an arrangement of the ground lines and signal lines on a region on the other side are symmetric with respect to the center line. In each of two connectors to which end portions of the flexible flat cable are coupled, terminals corresponding to the ground lines are grounded, a terminal corresponding to a signal line interposed between two ground lines is assigned a high-speed signal, and a terminal corresponding to another signal line is assigned a ground potential.

9 Claims, 14 Drawing Sheets

ELECTRONIC APPARATUS WITH FLEXIBLE FLAT CABLE FOR HIGH-SPEED SIGNAL TRANSMISSION

CROSS-REFERENCE TO RELATED APPLICATIONS

This application is based upon and claims the benefit of priority from Japanese Patent Application No. 2007-084279, filed Mar. 28, 2007, the entire contents of which are incorporated herein by reference.

BACKGROUND

1. Field

One embodiment of the invention relates generally to an electronic apparatus such as a personal computer, and more particularly to an electronic apparatus including two electronic components which are interconnected by a flexible flat cable.

2. Description of the Related Art

In general, in the field of electronic apparatuses such as a personal computer and a communication apparatus, flexible flat cables (FFC) are widely known as mechanisms for interconnecting electronic components. The flexible flat cable can easily connect electronic components by virtue of its high flexibility. Normally, the flexible flat cable is composed of a plurality of conductors which are interposed between two insulation layers.

Recently, the flexible flat cable has begun to be also used for transmission of high-speed signals. Jpn. Pat. Appln. KOKAI Publication No. 2003-217360 discloses a flexible flat cable which includes a dedicated ground layer which is used for impedance matching of signal lines in the flexible flat cable. The flexible flat cable comprises a plurality of signal lines which are arranged on the front surface of an insulation layer, a ground layer which is provided on the back surface of the insulation layer, and drain wires which are in contact with the ground layer. In the vicinity of an end portion of the flexible flat cable, the drain wires are led out from the lower surface side of the insulation layer to the upper surface side of the insulation layer, and are put in contact with two signal lines (ground lines) which are positioned on both outer sides of the plural signal lines.

In the structure of the flexible flat cable of the above-described KOKAI Publication No. 2003-217360, however, dedicated through-holes for leading the drain wires from the lower surface side of the insulation layer to the upper surface side of the insulation layer have to be provided in the insulation layer. This considerably increases the manufacturing cost of the flexible flat cable.

In the meantime, in usual cases, not only high-speed signals, but also ordinary signals that require no high speed transmission, as well as a ground potential and a positive power supply potential, are transmitted through the flexible flat cable that interconnects two electronic components. In this case, a signal line, which requires exact impedance matching, is only the signal line that is used for transmission of high-speed signals. It is necessary, therefore, to realize a novel cable structure for securing high-speed transmission characteristics with respect to only the signal line for transmitting high-speed signals.

In addition, as regards the flexible fiat cable, it is necessary to make some devices for facilitating an assembling work of an electronic apparatus and a reassembling work after repair of an electronic apparatus.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, there is provided an electronic apparatus comprising: a flexible flat cable which interconnects a first electronic component and a second electronic component, the flexible flat cable including a first insulation layer, a plurality of signal lines and a plurality of ground lines which are disposed in parallel on the first insulation layer, a second insulation layer which is provided on the plurality of signal lines and the plurality of ground lines in such a manner as to expose both end portions of the plurality of signal lines and the plurality of ground lines, an electromagnetic shield layer provided on the second insulation layer, and a plurality of connection lines which electrically connect the plurality of ground lines and the electromagnetic shield layer, each of the plurality of connection lines including a first connection line member which extends from one end portion of the associated ground line and is held between the second insulation layer and the electromagnetic shield layer, and a second connection line member which extends from the other end portion of the associated ground line and is held between the second insulation layer and the electromagnetic shield layer, an arrangement of the signal lines and the ground lines that are positioned on one side of a center line of the flexible flat cable, which is parallel to a longitudinal direction of the flexible flat cable, and an arrangement of the signal lines and the ground lines that are positioned on the other side of the center line being symmetric with respect to the center line; and a first connector and a second connector which are provided in the first electronic component and the second electronic component, respectively, and are connected to one end portion and the other end portion of the flexible flat cable, respectively, each of the first and second connectors including a plurality of signal terminals corresponding to the plurality of signal lines and a plurality of ground terminals corresponding to the plurality of ground lines, each of the plurality of ground terminals being grounded, at least one signal terminal of the plurality of signal terminals, which is interposed between two neighboring ones of the plurality of ground terminals, being assigned a signal which is to be transmitted from one of the first and second electronic components to the other, and at least one other signal terminal of the plurality of signal terminals being assigned a ground potential that is a reference signal which is to be transmitted from one of the first and second electronic components to the other.

Figure 1:
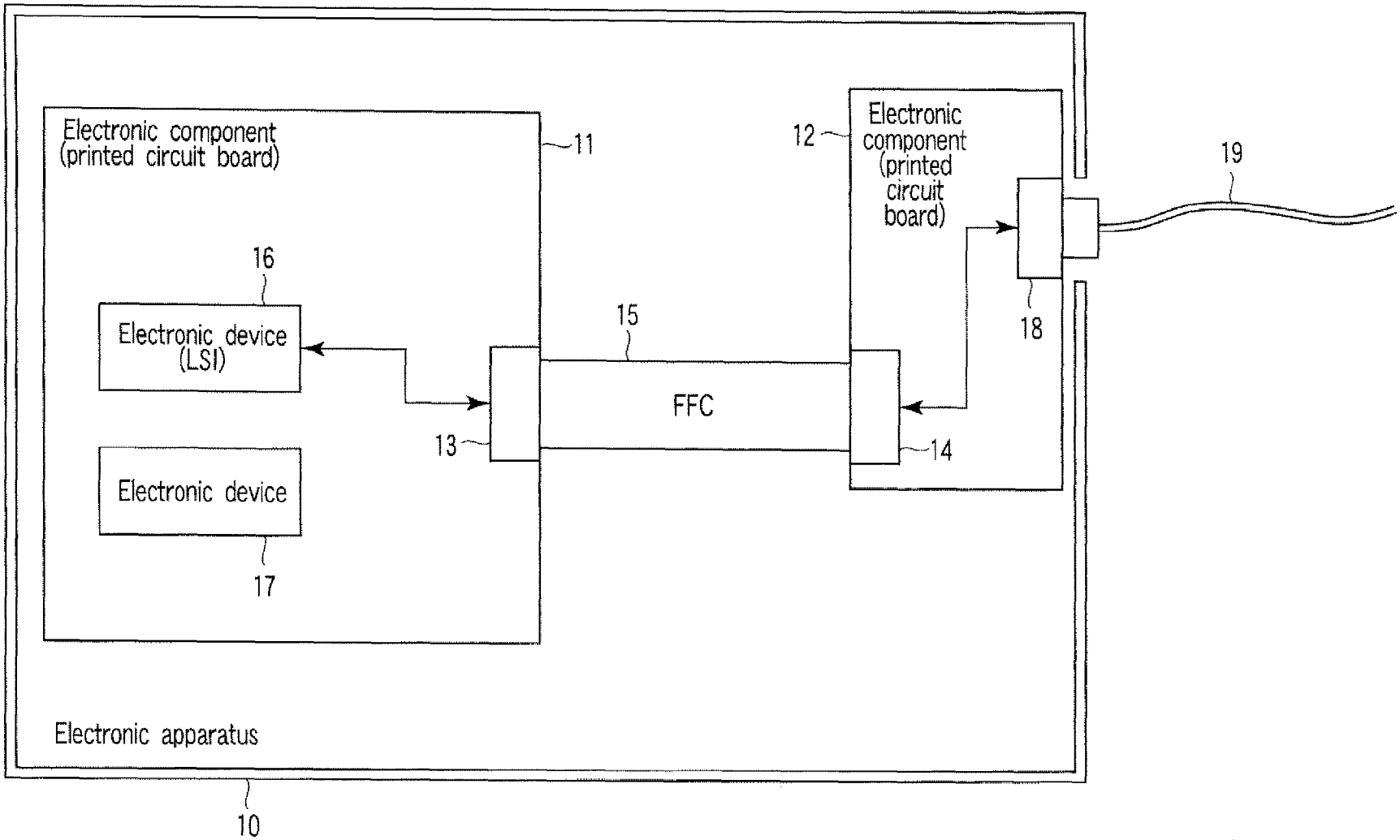
FIG. 1 is an exemplary block diagram that schematically shows the structure of an electronic apparatus according to an embodiment of the present invention.

To begin with, referring to FIG. 1, the outline of the structure of an electronic apparatus according to the embodiment of the invention is described. The electronic apparatus 10 is realized, for example, as a personal computer (information processing apparatus), an audio/video apparatus or a communication apparatus. The electronic apparatus 10 includes two (first and second) electronic components 11 and 12, and a flexible flat cable (FFC) 15 which electrically connects the two electronic components 11 and 12.

The first electronic component 11 includes a printed circuit board. A first connector 13 and electronic devices 16 and 17 are provided on the printed circuit board. Each of the electronic devices 16 and 17 is an electronic circuit such as an LSI. The first connector 13 is a connector (also referred to as "FFC connector") for connecting the flexible flat cable (FFC) 15 to the printed circuit board of the first electronic component 11. The electronic device 16 is a device which executes communication with the second electronic component 12. The electronic device 16 transmits various signals including a high-speed signal, such as Universal Serial Bus (USB) signal, to the second electronic component 12 via the first connector 13 and flexible flat cable (FFC) 15.

The second electronic component 12, too, includes a printed circuit board, for instance. A second connector 14 and an external connector 18 are provided on this printed circuit board. The second connector 14 is a connector (also referred to as "FFC connector") for connecting the flexible flat cable (FFC) 15 to the printed circuit board of the second electronic component 12. The external connector 18 is a connector for connecting an external device, such as a USB device, to the electronic apparatus 10 via a cable 19. The external connector 18 sends various signals, which are received from the first electronic component 11 via the flexible flat cable 15 and second connector 14, to the external device via the cable 19.

The flexible flat cable 15 electrically connects the two electronic components 11 and 12. One end portion of the flexible flat cable 15 is connected to the connector 13 of the electronic component 11, and the other end portion of the flexible flat cable 15 is connected to the connector 14 of the electronic component 12.

Figure 2:
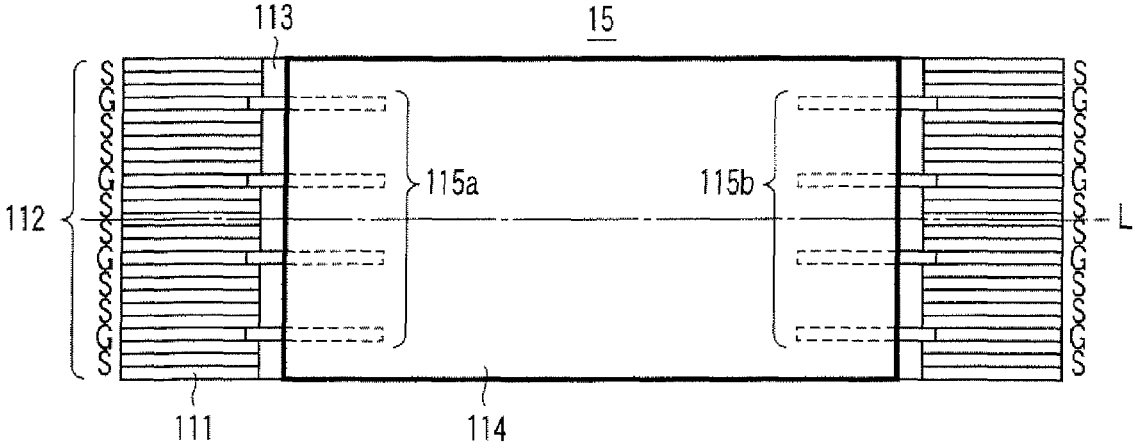
FIG. 2 is an exemplary plan view showing the structure of a flexible flat cable which is applied to the electronic apparatus shown in FIG. 1.
Figure 3:
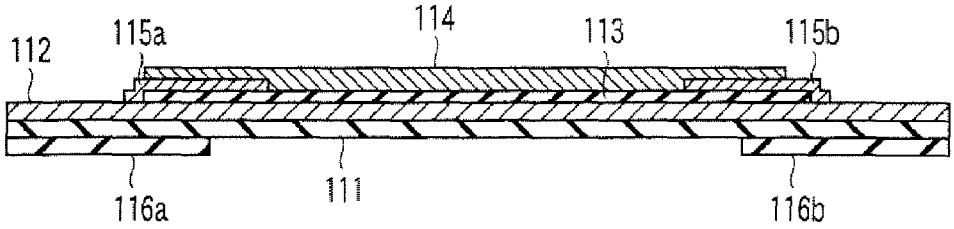
FIG. 3 is an exemplary cross-sectional view showing the structure of the flexible flat cable which is applied to the electronic apparatus shown in FIG. 1.
Figure 4:
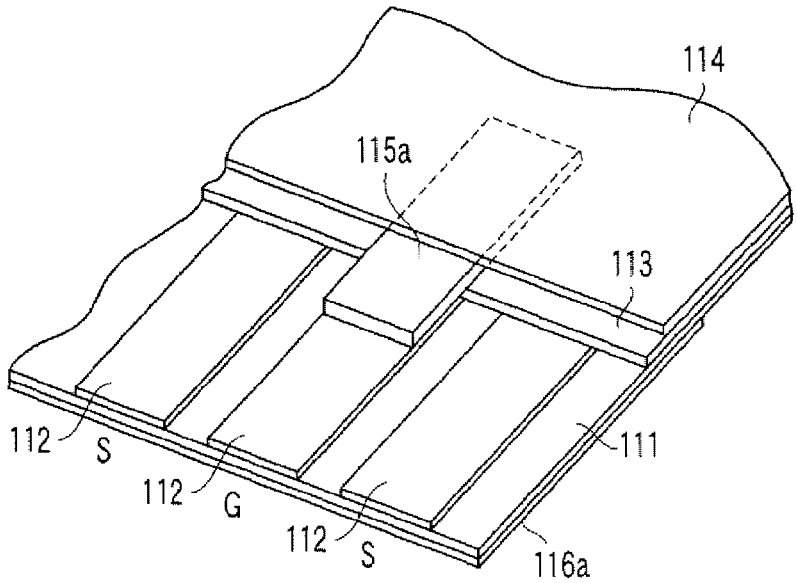
FIG. 4 is an exemplary perspective view showing the structure of an end portion of the flexible flat cable which is applied to the electronic apparatus shown in FIG. 1.

Next, referring to FIG. 2 to FIG. 4, the structure of the flexible flat cable 15 is described.

FIG. 2 is a plan view showing the flexible flat cable 15 from above. FIG. 3 is a cross-sectional view showing a cross-sectional structure of the flexible flat cable 15 along a ground line (G) in the flexible flat cable 15. FIG. 4 is a perspective view showing the structure of one end portion of the flexible flat cable 15.

The flexible flat cable 15 includes a flexible first insulation layer (insulation film) 111, a plurality of conductors (electrical conductors) 112, a flexible second insulation layer (insulation film) 113, a plurality of connection line members (drain line members) 115*a* and 115*b*, an electromagnetic shield layer 114, and two reinforcement members 116*a* and 116*b*.

The plural conductors 112 are arranged in parallel on the first insulation layer 111. Each of the plural conductors 112 has an equal line width. In addition, the interval between every two neighboring conductors 112 is equal. The plural conductors 112 comprise a plurality of signal lines S and a plurality of ground lines G. Specifically, the plural signal lines S and plural ground lines G are arranged in parallel on the first insulation layer 111.

The flexible second insulation layer 113 is provided on the plural signal lines S and plural ground lines G such that both end portions of the signal lines S and ground lines G are exposed. Specifically, the plural signal lines S and plural ground lines G are held between the first insulation layer 111 and the second insulation layer 113. At both end portions of the flexible flat cable 15, the second insulation layer 113 is removed, and thereby both end portions of the plural signal lines S and both end portions of the plural ground lines G are exposed.

The electromagnetic shield layer 114 is provided on the second insulation layer 113. The electromagnetic shield layer 114 is a film for preventing malfunction that is caused by EMI disturbance. The electromagnetic shield layer 114 includes an electrically conductive layer which contains a metal such as aluminum or silver.

Each of the ground lines G is provided with two connection line members (drain line members) 115*a* and 115*b*. Each ground line G is electrically connected to the electromagnetic shield layer 114 by the two connection line members (drain line members) 115*a* and 115*b*.

The connection line member (drain line member) 115*a* extends from one end portion of the associated ground line G, and is held between the second insulation layer 113 and the electromagnetic shield layer 114. Specifically, one end portion of the connection line member (drain line member) 115*a* is connected to one exposed end portion of the associated ground line G, and the connection line member (drain line member) 115*a* extends onto one end portion of the second insulation layer 113.

The connection line member (drain line member) 115*b* extends from the other end portion of the associated ground line G, and is held between the second insulation layer 113 and the electromagnetic shield layer 114. Specifically, one end portion of the connection line member (drain line member) 115*b* is connected to the other exposed end portion of the associated ground line G, and the connection line member (drain line member) 115*b* extends onto the other end portion of the second insulation layer 113.

As described above, both end portions of each ground line G are electrically connected to the electromagnetic shield layer 114 by the two connection line members 115*a* and 115*b*. One connection line, which electrically connects the ground line G and the electromagnetic shield layer 114, is constituted by the associated two connection line members 115*a* and 115*b*. In other words, the plural ground lines G are electrically connected to the electromagnetic shield layer 114 by the same number of connection lines (drain lines) as the number of the ground lines G, and each connection line is composed of two connection line members (drain line members) 115*a* and 115*b*.

The connection lines are connected only to the conductors 112 which function as ground lines G of the plural conductors 112, and are not connected to the conductors 112 which function as signal lines S.

One or more signal lines S are interposed between two neighboring ground lines G. These signal lines S are used as high-speed signal lines for transmitting high-speed signals. Examples of high-speed signals are a pair of differential signals, and a single end signal. In a case where a pair of differential signals are used as high-speed signals, two signal lines S are present between two neighboring ground lines G in the flexible flat cable 15, as shown in FIG. 2. These two signal lines S are used as a differential signal line pair for transmitting a pair of differential signals.

For example, in a case where three pairs of differential signals are transmitted, four ground lines G, for instance, are provided in the flexible flat cable 15, as shown in FIG. 2. Two signal lines S, which are interposed between two neighboring ground lines G, are used for transmission of one pair of differential signals. Signal lines, which are not interposed between ground lines G, are used for transmission of ordinary signals that require no high speed transmission, or for transmission of a ground potential or a positive power supply potential.

In short, each ground line G functions as a dedicated conductor for controlling a characteristic impedance of each high-speed signal line. Since each ground line G is electrically connected to the electromagnetic shield layer 114 by two connection line members (drain line members) 115*a* and 115*b*, the ground line G can provide a necessary and sufficient ground reference for high-speed signal transmission. One or more signal lines S, which are interposed between two ground lines G each having a sufficient ground reference, are used for transmission of high-speed signals, and thereby high-speed signals of, e.g. 100 MHz or more can normally be transmitted. In this manner, each ground line G is used only for realizing high-speed signal transmission, and the ground line G is not used for transmission of an ordinary ground potential as a reference potential. An arbitrary signal line S is used for transmission of a ground potential. As described above, the ground lines G are used as dedicated conductors for controlling the characteristic impedance of high-speed signal lines and a signal line S is used for transmission of a ground potential. Thereby, the number of necessary ground lines G, that is, the number of connection lines, can be minimized. Hence, the number of connection lines, which are to be provided in the flexible flat cable 15, can be minimized and the fabrication process of the flexible flat cable 15 can be simplified. In addition, since the connection line members, which extend from exposed end portions of the ground lines G onto the second insulation layer 113, are used for connection between the ground lines G and the electromagnetic shield layer 114, there is no need to provide through-holes, or the like, in the second insulation layer 113, and the structure of the flexible flat cable 15 can be simplified.

In the flexible flat cable 15, the arrangement of signal lines S and ground lines G that are positioned on one side of a center line L of the flexible flat cable 15, which is parallel to the longitudinal direction of the flexible flat cable 15, and the arrangement of signal lines S and ground lines G that are positioned on the other side of the center line L are symmetric with respect to the center line L. Thereby, the flexible flat cable 15 can be non-polarized, and thus the first electronic component 11 and second electronic component 12 can normally be connected via the flexible flat cable 15, regardless of the direction of the flexible flat cable 15, that is, regardless of which of one end portion and the other end portion of the flexible flat cable 15 is connected to which of the two connectors 13 and 14. This means that facilitation of assembling and reassembling works of the electronic apparatus 10 can be realized. In other words, the worker may simply insert both end portions of the flexible flat cable 15 to the two connectors 13 and 14 without taking care of the direction of the flexible flat cable 15.

Figure 5:
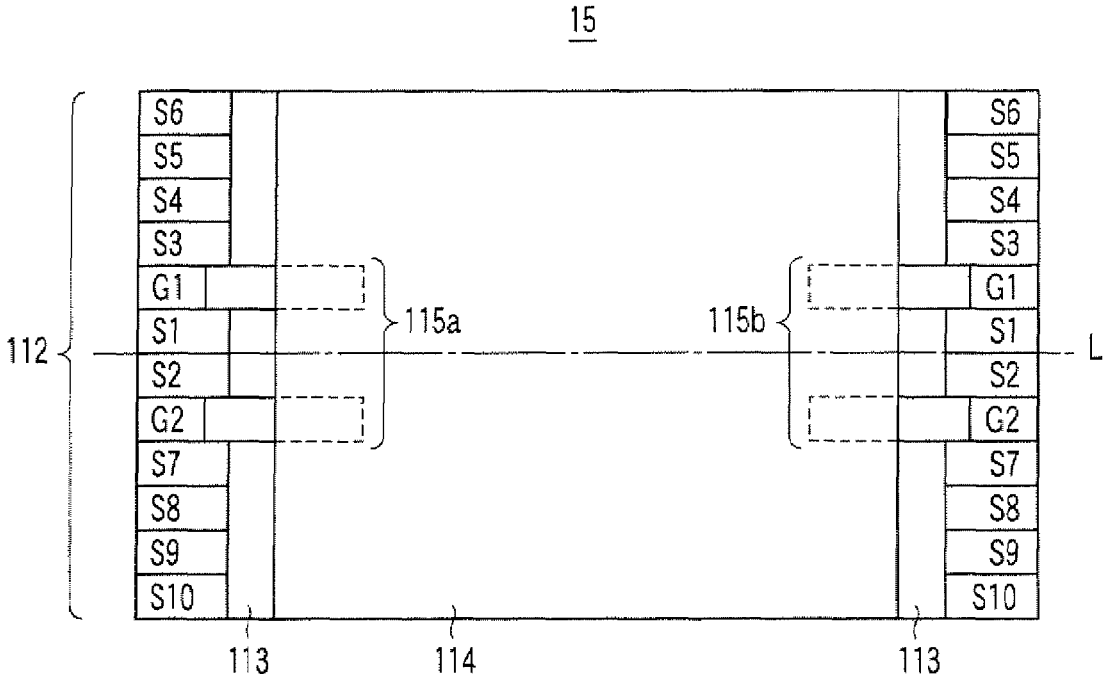
FIG. 5 shows a first example of conductor assign of the flexible flat cable which is applied to the electronic apparatus shown in FIG. 1.
Figure 7:
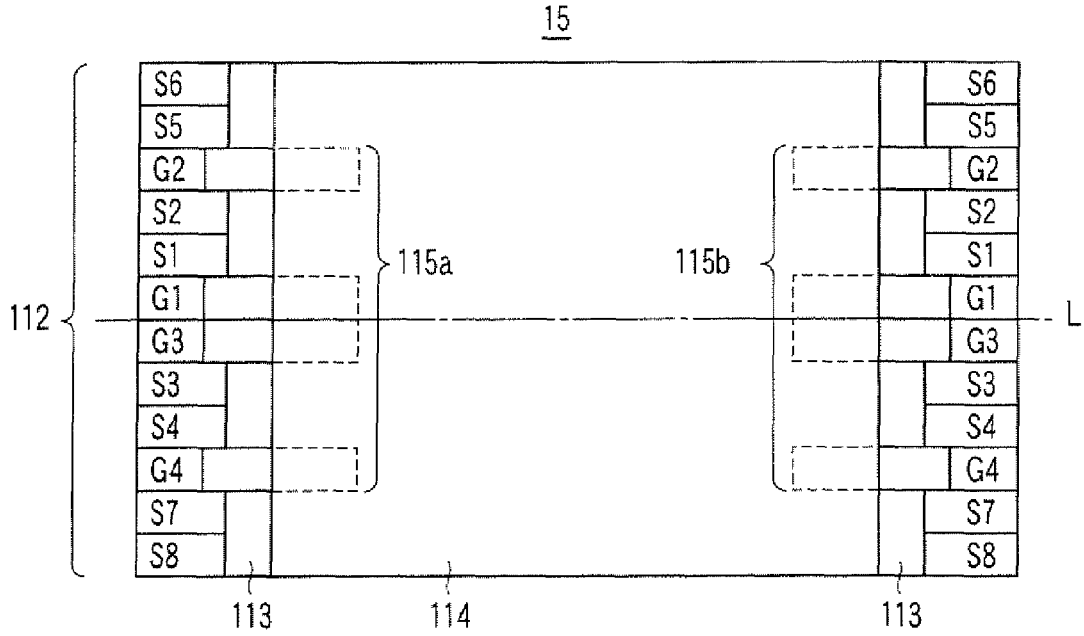
FIG. 7 shows a third example of conductor assign of the flexible flat cable which is applied to the electronic apparatus shown in FIG. 1.

Next, referring to FIG. 5 and FIG. 7, a description is given of arrangement ("conductor assign") of signal lines S and ground lines G, which is applied to the flexible flat cable 15.

FIG. 5 shows an example of conductor assign, which corresponds to a case in which the number of conductors 12 in the flexible flat cable 15 (i.e. the total number of plural signal lines S and plural ground lines G) is an even number (e.g. 12) and high-speed signals, which are to be transmitted via the flexible flat cable 15, are only a single pair of differential signals.

In the flexible flat cable 15 shown in FIG. 5, the plural signal lines S include two signal lines S1 and S2 which neighbor with a center line L being interposed, and the plural ground lines G include first and second ground lines G1 and G2 which are disposed on both sides of the two signal lines S1 and S2.

Specifically, in a region on one side of the center line L (i.e. the upper side of the center line L in FIG. 5), the first signal line S1, the first ground line G1 and third to sixth signal lines S3 to S6 are successively arranged in the named order from the center line L toward the outside of the region on the one side of the center line L. One end portion of the first ground line G1 is connected to the electromagnetic shield layer 114 by the connection line member 115*a*, and the other end portion of the first ground line G1 is connected to the electromagnetic shield layer 114 by the connection line member 115*b*. In a region on the other side of the center line L (i.e. the lower side of the center line L in FIG. 5), the second signal line S2, the second ground line G2 and seventh to tenth signal lines S7 to S10 are successively arranged in the named order from the center line L toward the outside of the region on the other side of the center line L. One end portion of the second ground line G2 is connected to the electromagnetic shield layer 114 by the connection line member 115*a*, and the other end portion of the second ground line G2 is connected to the electromagnetic shield layer 114 by the connection line member 115*b*.

The two signal lines S1 and S2, which are interposed between the two ground lines G1 and G2, are used for transmission of a pair of differential signals. The other signal lines S3 to S10 are used for transmission of ordinary signals, a ground potential and a positive power supply potential.

Figure 6:
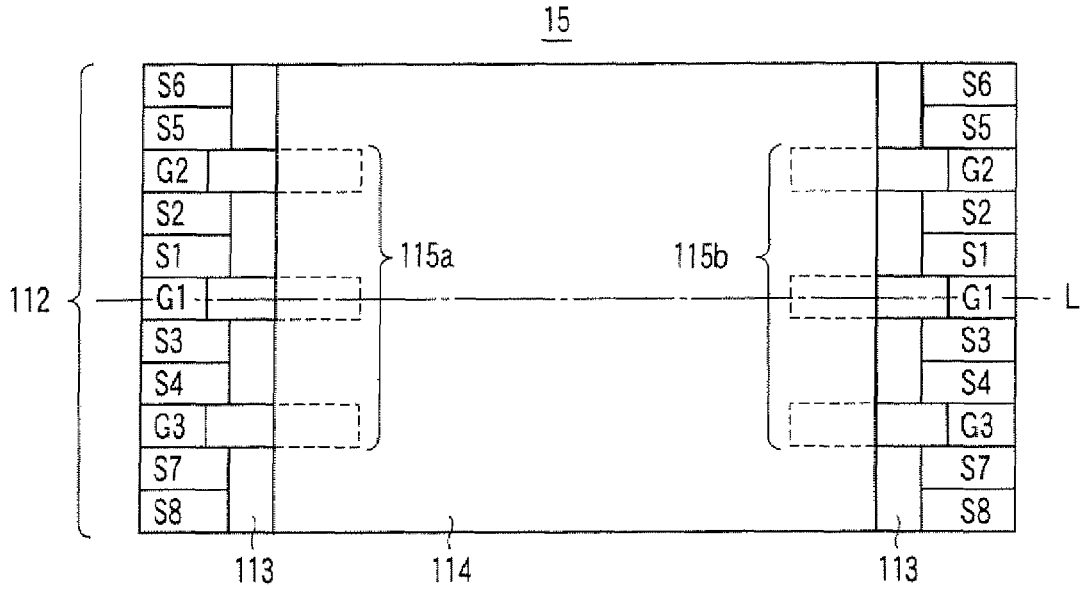
FIG. 6 shows a second example of conductor assign of the flexible flat cable which is applied to the electronic apparatus shown in FIG. 1.

FIG. 6 shows an example of conductor assign, which corresponds to a case in which the number of conductors 12 in the flexible flat cable 15 (i.e. the total number of plural signal lines S and plural ground lines G) is an odd number (e.g. 11) and high-speed signals, which are to be transmitted via the flexible flat cable 15, are a pair of first differential signals and a pair of second differential signals.

The first ground line G1 is disposed on the center line L of the flexible flat cable 15. One end portion of the first ground line G1 is connected to the electromagnetic shield layer 114 by the connection line member 115*a*, and the other end portion of the first ground line G1 is connected to the electromagnetic shield layer 114 by the connection line member 115*b*.

In a region on one side of the center line L of the flexible flat cable 15 (i.e. the upper side of the center line L in FIG. 6), the first signal line S1, second signal line S2 and second ground line G2 are successively arranged in the named order from the center line L toward the outside of the region on the one side of the center line L. Further, the fifth signal line S5 and sixth signal line S6 are successively arranged on the outside of the second ground line G2. One end portion of the second ground line G2 is connected to the electromagnetic shield layer 114 by the connection line member 115*a*, and the other end portion of the second ground line G2 is connected to the electromagnetic shield layer 114 by the connection line member 115*b*.

In a region on the other side of the center line L (i.e. the lower side of the center line L in FIG. 6), the third signal line S3, fourth signal line S4 and third ground line G3 are successively arranged in the named order from the center line L toward the outside of the region on the other side of the center line L. Further, the seventh signal line S7 and eighth signal line S8 are successively arranged on the outside of the third ground line G3. One end portion of the third ground line G3 is connected to the electromagnetic shield layer 114 by the connection line member 115*a*, and the other end portion of the third ground line G3 is connected to the electromagnetic shield layer 114 by the connection line member 115*b*.

The two signal lines S1 and S2, which are interposed between the two ground lines G1 and G2, are used for transmission of a pair of first differential signals. The two signal lines S3 and S4, which are interposed between the two ground lines G1 and G3, are used for transmission of a pair of second differential signals. The other signal lines S5 to S8 are used for transmission of ordinary signals, a ground potential and a positive power supply potential.

FIG. 7 shows an example of conductor assign, which corresponds to a case in which the number of conductors 12 in the flexible flat cable 15 (i.e. the total number of plural signal lines S and plural ground lines G) is an even number (e.g. 12) and high-speed signals, which are to be transmitted via the flexible flat cable 15, are a pair of first differential signals and a pair of second differential signals.

In a region on one side of the center line L of the flexible flat cable 15 (i.e. the upper side of the center line L in FIG. 7), the first ground line G1, first signal line S1, second signal line S2 and second ground line G2 are successively arranged in the named order from the center line L toward the outside of the region on the one side of the center line L. Further, the fifth signal line S5 and sixth signal line S6 are successively arranged on the outside of the second ground line G2. One end portion of the first ground line G1 is connected to the electromagnetic shield layer 114 by the connection line member 115*a*, and the other end portion of the first ground line G1 is connected to the electromagnetic shield layer 114 by the connection line member 115*b*. In addition, one end portion of the second ground line G2 is connected to the electromagnetic shield layer 114 by the connection line member 115*a*, and the other end portion of the second ground line G2 is connected to the electromagnetic shield layer 114 by the connection line member 115*b*.

In a region on the other side of the center line L of the flexible flat cable 15 (i.e. the lower side of the center line L in FIG. 7), the third ground line G3, third signal line S3, fourth signal line S4 and fourth ground line G4 are successively arranged in the named order from the center line L toward the outside of the region on the other side of the center line L. Further, the seventh signal line S7 and eighth signal line S8 are successively arranged on the outside of the fourth ground line G4. One end portion of the third ground line G3 is connected to the electromagnetic shield layer 114 by the connection line member 115*a*, and the other end portion of the third ground line G3 is connected to the electromagnetic shield layer 114 by the connection line member 115*b*. In addition, one end portion of the fourth ground line G4 is connected to the electromagnetic shield layer 114 by the connection line member 115*a*, and the other end portion of the fourth ground line G4 is connected to the electromagnetic shield layer 114 by the connection line member 115*b*.

The two signal lines S1 and S2, which are interposed between the two ground lines G1 and G2, are used for transmission of a pair of first differential signals. The two signal lines S3 and S4, which are interposed between the two ground lines G3 and G4, are used for transmission of a pair of second differential signals. The other signal lines S5 to S8 are used for transmission of ordinary signals, a ground potential and a positive power supply potential.

Figure 8:
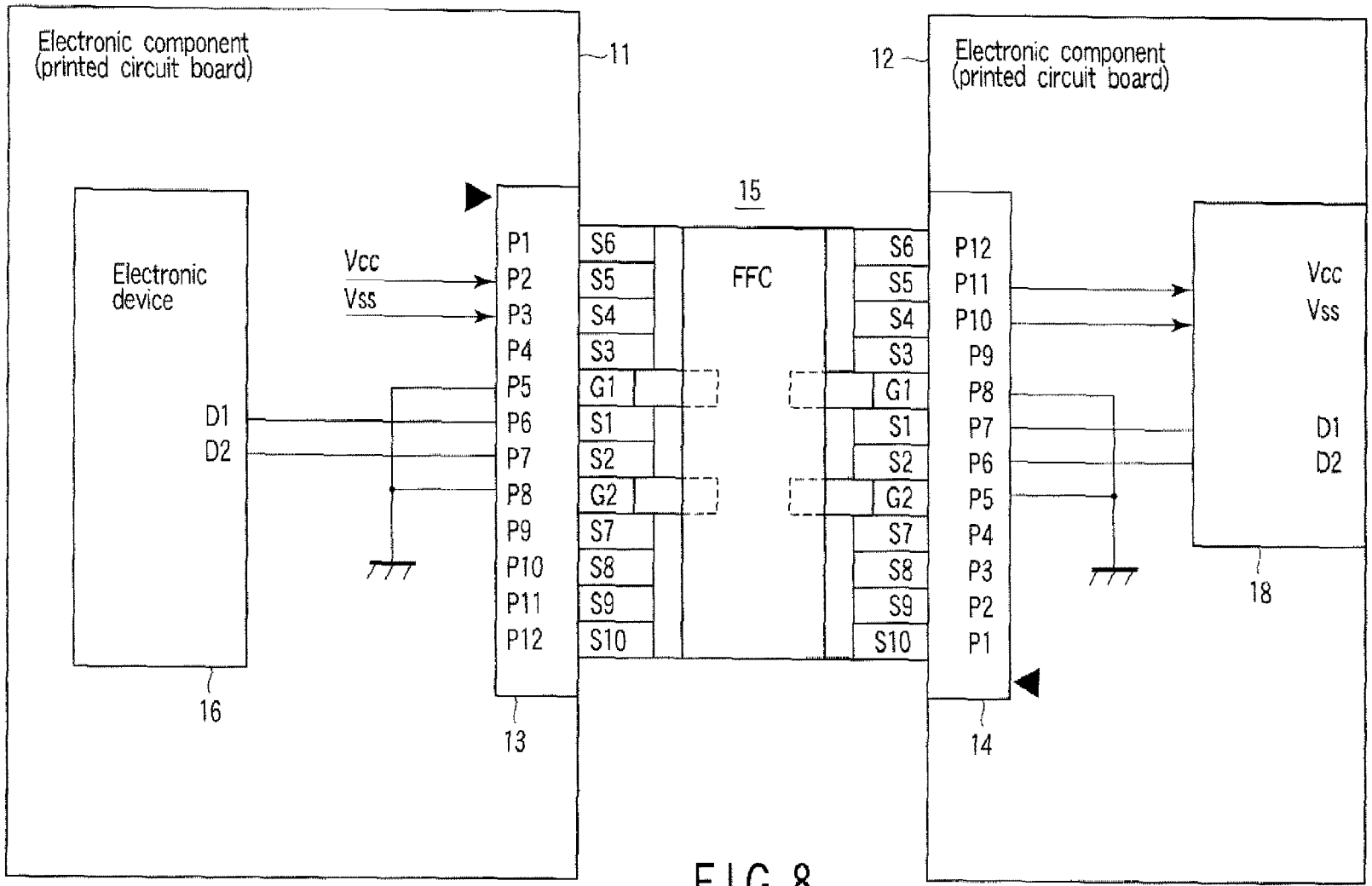
FIG. 8 is an exemplary block diagram showing a first example of the structures of two electronic components which are provided in the electronic apparatus shown in FIG. 1.
Figure 9:
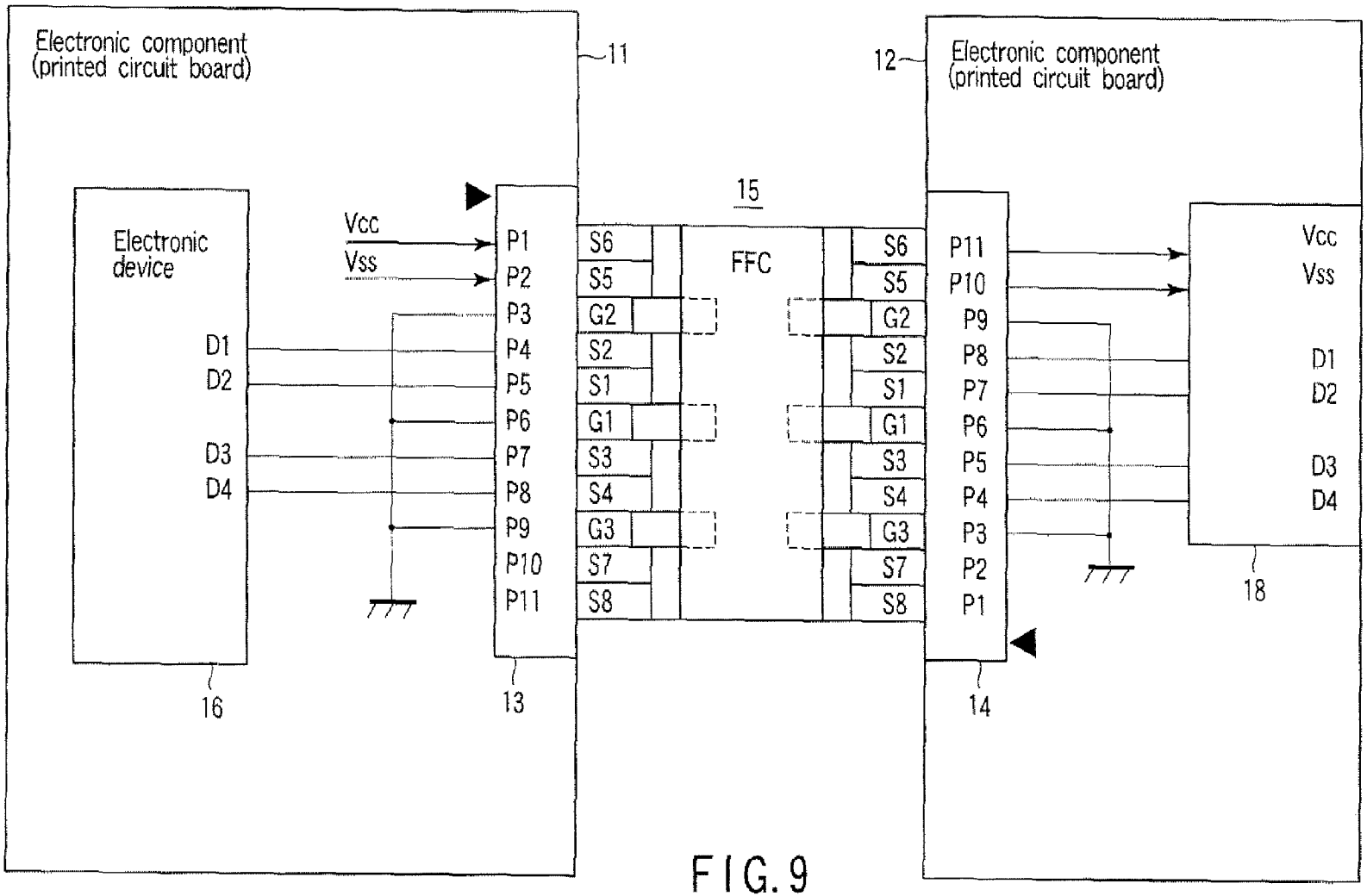
FIG. 9 is an exemplary block diagram showing a second example of the structures of the two electronic components which are provided in the electronic apparatus shown in FIG. 1.
Figure 10:
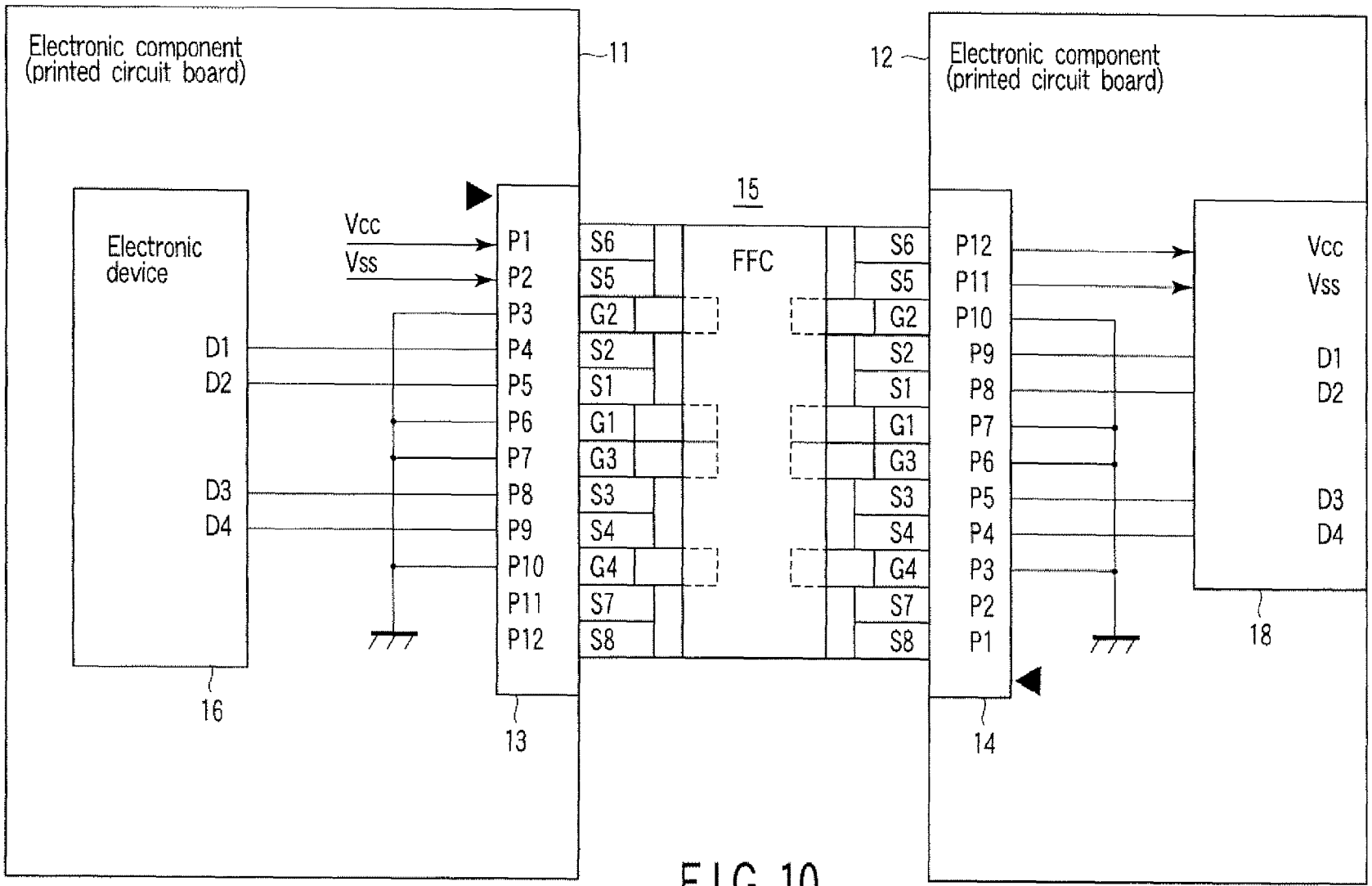
FIG. 10 is an exemplary block diagram showing a third example of the structures of the two electronic components which are provided in the electronic apparatus shown in FIG. 1.

Next, referring to FIG. 8 to FIG. 10, a description is given of an example of assignment of signals to connectors 13 and 14 ("pin assign") and an example of the structure of each of the two electronic components 11 and 12.

FIG. 8 shows an example of the structures of the two electronic components 11 and 12, which corresponds to a case of using the flexible flat cable 15 having the conductor assign shown in FIG. 5.

The connector 13, which is provided on the printed circuit board of the electronic component 11, has the same number of terminals (pins) as the number of conductors of the flexible flat cable 15. Since the number of conductors of the flexible flat cable 15 in this example is 12, the connection port of the connector 13 is provided with 12 terminals P1 to P12. The terminals P1 to P12 are arranged in the named order from the right end to the left end of the connection port of the connector 13 (from the upper end to the lower end in FIG. 8), as viewed from the flexible flat cable 15. The terminals P1 to P12 include a plurality of signal terminals which are connected to a plurality of signal lines in the flexible flat cable 15, and a plurality of ground terminals which are connected to a plurality of ground lines in the flexible flat cable 15. The terminals P1, P2, P3, P4, P6, P7, P9, P10, P11 and P12 are connected to signal lines S6, S5, S4, S3, S1, S2, S7, S8, S9 and S10, respectively, and these terminals function as signal terminals. The terminals P5 and P8 are connected to ground lines G1 and G2, and function as ground terminals.

On the printed circuit board of the electronic component 11, each of the ground terminals P5 and P8 is grounded. Specifically, each of the ground terminals P5 and P8 is fixedly connected to a ground electrode or the like, which is provided on the printed circuit board.

Of the signal terminals P1 to P4, P6, P7 and P9 to P12, the signal terminals P6 and P7, which are interposed between the two neighboring ground terminals P5 and P8, are assigned high-speed signals (e.g. a pair of differential signals D1 and D2) which are to be transmitted from one of the first and second electronic components 11 and 12 to the other. The pair of differential signals D1 and D2 are output, for example, from the electronic device 16 and are delivered to the signal terminals P6 and P7 via a differential signal line pair on the printed circuit board. At least one other signal terminal of the plural signal terminals P1 to P4, P6, P7 and P9 to P12, for instance, the signal terminal P3, is assigned a ground potential VSS that is a reference signal, which is to be transmitted from one of the first and second electronic components 11 and 12 to the other. Another signal terminal, for instance, signal terminal P2, is assigned a positive power supply potential VCC. In a case where power (positive power supply potential VCC, ground potential VSS) is supplied from the first electronic component 11 to the second electronic component 12 via the flexible flat cable 15, a positive power supply electrode and a ground electrode, which are provided on the printed circuit board of the first electronic component 11, are connected to the signal terminals P2 and P3. Needless to say, a positive power supply terminal and a ground terminal of a power supply circuit, which is provided on the printed circuit board, may be connected to the signal terminals 22 and P3.

The connector 14, which is provided on the printed circuit board of the electronic component 12, similarly has the same number of terminals (pins) as the number of conductors of the flexible flat cable 15. Specifically, the connection port of the connector 14 is provided with 12 terminals P1 to P12. The structure of the connector 14 is the same as the structure of the connector 13. Accordingly, the terminals P1 to P12 are arranged in the named order from the right end to the left end of the connection port of the connector 14 (from the lower end to the upper end in FIG. 8), as viewed from the flexible flat cable 15. The terminals P1 to P12 include a plurality of signal terminals which are connected to a plurality of signal lines in the flexible flat cable 15, and a plurality of ground terminals which are connected to a plurality of ground lines in the flexible flat cable 15. The terminals P1, P2, P3, P4, P6, P7, P9, P10, P11 and P12 are connected to signal lines S10, S9, S8, S7, S2, S1, S3, S4, S5 and S6, respectively, and these terminals function as signal terminals. The terminals P5 and P8 are connected to ground lines G2 and G1, and function as ground terminals.

On the printed circuit board of the electronic component 12, each of the ground terminals P5 and P8 is grounded. Specifically, each of the ground terminals P5 and P8 is fixedly connected to a ground electrode, which is provided on the printed circuit board.

Of the plural signal terminals P1 to P4, P6, P7 and P9 to P12, the signal terminals P6 and P7, which are interposed between the two neighboring ground terminals P5 and P8, are assigned the above-described pair of differential signals D1 and D2. The signal terminals P6 and P7 are connected to a pair of signal terminals in the external connector 18 via a differential signal line pair on the printed circuit board. Of the plural signal terminals P1 to P4, P6, P7 and P9 to P12, the signal terminal P11 which is connected to the signal line S5 is assigned the positive power supply potential VCC which is sent from the electronic component 11. In addition, of the plural signal terminals P1 to P4, P6, P7 and P9 to P12, the signal terminal P10 which is connected to the signal line S4 is assigned the ground potential VSS, which is sent from the electronic component 11. The signal terminal P11 and signal terminal P10 are connected to two signal terminals in the external connector 18 via two signal lines on the printed circuit board in order to supply power (VCC, VSS) to the external device.

FIG. 9 shows an example of the structures of the two electronic components 11 and 12, which corresponds to a case of using the flexible flat cable 15 having the conductor assign shown in FIG. 6.

The connector 13, which is provided on the printed circuit board of the electronic component 11, has the same number of terminals (pins) as the number of conductors of the flexible flat cable 15. Since the number of conductors of the flexible flat cable 15 in this example is 11, the connection port of the connector 13 is provided with 11 terminals P1 to P11. The terminals P1 to P11 are arranged in the named order from the right end to the left end of the connection port of the connector 13 (from the upper end to the lower end in FIG. 9), as viewed from the flexible flat cable 15. The terminals P1 to P11 include a plurality of signal terminals which are connected to a plurality of signal lines in the flexible flat cable 15, and a plurality of ground terminals which are connected to a plurality of ground lines in the flexible flat cable 15. The terminals P1, P2, P4, P5, P7, P8, P10 and P11 are connected to signal lines S6, S5, S2, S1, S3, S4, S7 and S8, respectively, and these terminals function as signal terminals. The terminals P3, P6 and P9 are connected to ground lines G2, G1 and G3, and function as ground terminals.

On the printed circuit board of the electronic component 11, each of the ground terminals P3, P6 and P9 is grounded. Specifically, each of the ground terminals P3, P6 and P9 is fixedly connected to a ground electrode or the like, which is provided on the printed circuit board.

Of the signal terminals P1, P2, P4, P5, P7, P8, P10 and P11, the signal terminals P4 and P5, which are interposed between the two neighboring ground terminals P3 and P6, are assigned high-speed signals (e.g. a pair of differential signals D1 and D2) which are to be transmitted from one of the first and second electronic components 11 and 12 to the other. The pair of differential signals D1 and D2 are output, for example, from the electronic device 16 and are delivered to the signal terminals P4 and P5 via a differential signal line pair on the printed circuit board. In addition, of the signal terminals P1, P2, P4, P5, P7, P8, P10 and P11, the signal terminals P7 and P8, which are interposed between the two neighboring ground terminals P6 and P9, are assigned high-speed signals (e.g. a pair of differential signals D3 and D4) which are to be transmitted from one of the first and second electronic components 11 and 12 to the other. The pair of differential signals D3 and D4 are output, for example, from the electronic device 16 and are delivered to the signal terminals P7 and P8 via a differential signal line pair on the printed circuit board.

At least one other signal terminal of the plural signal terminals P1, P2, P4, P5, P7, P8, P10 and P11, for example, the signal terminal P2, is assigned a ground potential VSS that is a reference signal, which is to be transmitted from one of the first and second electronic components 11 and 12 to the other. Another signal terminal, for instance, signal terminal P1, is assigned a positive power supply potential VCC. In a case where power (positive power supply potential VCC, ground potential VSS) is supplied from the first electronic component 11 to the second electronic component 12 via the flexible flat cable 15, a positive power supply electrode and a ground electrode, which are provided on the printed circuit board of the first electronic component 11, are connected to the signal terminals P1 and P2. Needless to say, a positive power supply terminal and a ground terminal of a power supply circuit, which is provided on the printed circuit board, may be connected to the signal terminals P1 and P2.

The connector 14, which is provided on the printed circuit board of the electronic component 12, similarly has the same number of terminals (pins) as the number of conductors of the flexible flat cable 15. Specifically, the connection port of the connector 14 is provided with 11 terminals P1 to P11. The structure of the connector 14 is the same as the structure of the connector 13. Accordingly, the terminals P1 to P11 are arranged in the named order from the right end to the left end of the connection port of the connector 14 (from the lower end to the upper end in FIG. 9), as viewed from the flexible flat cable 15. The terminals P1 to P11 include a plurality of signal terminals which are connected to a plurality of signal lines in the flexible flat cable 15, and a plurality of ground terminals which are connected to a plurality of ground lines in the flexible flat cable 15. The terminals P1, P2, P4, P5, P7, P8, P10 and P11 are connected to signal lines S8, S7, S4, S3, S1, S2, S5 and S6, respectively, and these terminals function as signal terminals. The terminals P3, P6 and P9 are connected to ground lines G3, G1 and G2, and function as ground terminals.

On the printed circuit board of the electronic component 12, each of the ground terminals P3, P6 and P9 is grounded. Specifically, each of the ground terminals P3, P6 and P9 is fixedly connected to a ground electrode, which is provided on the printed circuit board.

Of the plural signal terminals P1, P2, P4, P5, P7, P8, P10 and P11, the signal terminals P8 and P7, which are interposed between the two neighboring ground terminals P9 and P6, are assigned the above-described pair of differential signals D1 and D2. The signal terminals P8 and P7 are connected to a pair of signal terminals in the external connector 18 via a differential signal line pair on the printed circuit board. In addition, of the plural signal terminals P1, P2, P4, P5, P7, P8, P10 and P11, the signal terminals P5 and P4, which are interposed between the two neighboring ground terminals P6 and P3, are assigned the above-described pair of differential signals D3 and D4. The signal terminals P5 and P4 are connected to a pair of signal terminals in the external connector 18 via a differential signal line pair on the printed circuit board.

Of the plural signal terminals P1, P2, P4, P5, P7, P8, P10 and P11, the signal terminal P11 which is connected to the signal line S6 is assigned the positive power supply potential VCC which is sent from the electronic component 11. In addition, of the plural signal terminals P1, P2, P4, P5, P7, P8, P10 and P11, the signal terminal P10 which is connected to the signal line S5 is assigned the ground potential VSS, which is sent from the electronic component 11. The signal terminal P11 and signal terminal P10 are connected to two signal terminals in the external connector 18 via two signal lines on the printed circuit board.

FIG. 10 shows an example of the structures of the two electronic components 11 and 12, which corresponds to a case of using the flexible flat cable 15 having the conductor assign shown in FIG. 7.

The connector 13, which is provided on the printed circuit board of the electronic component 11, has the same number of terminals (pins) as the number of conductors of the flexible flat cable 15. Since the number of conductors of the flexible flat cable 15 in this example is 12, the connection port of the connector 13 is provided with 12 terminals P1 to P12. The terminals P1 to P12 are arranged in the named order from the right end to the left end of the connection port of the connector 13 (from the upper end to the lower end in FIG. 10), as viewed from the flexible flat cable 15. The terminals P1 to P12 include a plurality of signal terminals which are connected to a plurality of signal lines in the flexible flat cable 15, and a plurality of ground terminals which are connected to a plurality of ground lines in the flexible flat cable 15. The terminals P1, P2, P4, P5, P8, P9, P11 and P12 are connected to signal lines S6, S5, S2, S1, S3, S4, S7 and S8, respectively, and these terminals function as signal terminals. The terminals P3, P6, P7 and P10 are connected to ground lines G2, G1, G3 and G4, and function as ground terminals.

On the printed circuit board of the electronic component 11, each of the ground terminals P3, P6, P7 and P10 is grounded. Specifically, each of the ground terminals P3, P6, P7 and P10 is fixedly connected to a ground electrode or the like, which is provided on the printed circuit board.

Of the signal terminals P1, P2, P4, P5, P8, P9, P11 and P12, the signal terminals P4 and P5, which are interposed between the two neighboring ground terminals P3 and P6, are assigned high-speed signals (e.g. a pair of differential signals D1 and D2) which are to be transmitted from one of the first and second electronic components 11 and 12 to the other. The pair of differential signals D1 and D2 are output, for example, from the electronic device 16 and are delivered to the signal terminals P4 and P5 via a differential signal line pair on the printed circuit board. In addition, of the signal terminals P1, P2, P4, P5, P8, P9, P11 and P12, the signal terminals P8 and P9, which are interposed between the two neighboring ground terminals P7 and P10, are assigned high-speed signals (e.g. a pair of differential signals D3 and D4) which are to be transmitted from one of the first and second electronic components 11 and 12 to the other. The pair of differential signals D3 and D4 are output, for example, from the electronic device 16 and are delivered to the signal terminals P8 and P9 via a differential signal line pair on the printed circuit board.

At least one other signal terminal of the plural signal terminals P1, P2, P4, P5, P8, P9, P11 and P12, for instance, the signal terminal P2, is assigned a ground potential VSS that is a reference signal, which is to be transmitted from one of the first and second electronic components 11 and 12 to the other. Another signal terminal, for instance, the signal terminal P1, is assigned a positive power supply potential VCC. In a case where power (positive power supply potential VCC, ground potential VSS) is supplied from the first electronic component 11 to the second electronic component 12 via the flexible flat cable 15, a positive power supply electrode and a ground electrode, which are provided on the printed circuit board of the first electronic component 11, are connected to the signal terminals P1 and P2. Needless to say, a positive power supply terminal and a ground terminal of a power supply circuit, which is provided on the printed circuit board, may be connected to the signal terminals P1 and P2.

The connector 14, which is provided on the printed circuit board of the electronic component 12, similarly has the same number of terminals (pins) as the number of conductors of the flexible flat cable 15. Specifically, the connection port of the connector 14 is provided with 12 terminals P1 to P12. The structure of the connector 14 is the same as the structure of the connector 13. Accordingly, the terminals P1 to P12 are arranged in the named order from the right end to the left end of the connection port of the connector 14 (from the lower end to the upper end in FIG. 10), as viewed from the flexible flat cable 15. The terminals P1 to P12 include a plurality of signal terminals which are connected to a plurality of signal lines in the flexible flat cable 15, and a plurality of ground terminals which are connected to a plurality of ground lines in the flexible flat cable 15. The terminals P11 P2, P4, P5, P8, P9, P11 and P12 are connected to signal lines S8, S7, S4, S3, S1, S2, S5 and S6, respectively, and these terminals function as signal terminals. The terminals P3, P6, P7 and P10 are connected to ground terminals G4, G3, G1 and G2, and function as ground lines.

On the printed circuit board of the electronic component 12, each of the ground terminals P3, P6, P7 and P10 is grounded. Specifically, each of the ground terminals P3, P6, P7 and P10 is fixedly connected to a ground electrode, which is provided on the printed circuit board.

Of the plural signal terminals P1, P2, P4, P5, P8, P9, P11 and P12, the signal terminals P9 and P8, which are interposed between the two neighboring ground terminals P10 and P7, are assigned the above-described pair of differential signals D1 and D2. The signal terminals P9 and P8 are connected to a pair of signal terminals in the external connector 18 via a differential signal line pair on the printed circuit board. In addition, of the plural signal terminals P1, P2, P4, P5, P8, P9, P11 and P12, the signal terminals P5 and P4, which are interposed between the two neighboring ground terminals P6 and P3, are assigned the above-described pair of differential signals D3 and D4. The signal terminals P5 and P4 are connected to a pair of signal terminals in the external connector 18 via a differential signal line pair on the printed circuit board.

Of the plural signal terminals P1, P2, P4, P5, P8, P9, P11 and P12, the signal terminal P12, which is connected to the signal line S6, is assigned the positive power supply potential VCC which is sent from the electronic component 11. In addition, the signal terminal P11, which is connected to the signal line S5, is assigned the ground potential VSS which is sent from the electronic component 11. The signal terminal P12 and signal terminal P11 are connected to two signal terminals in the external connector 18 via two signal lines on the printed circuit board.

Figure 11:
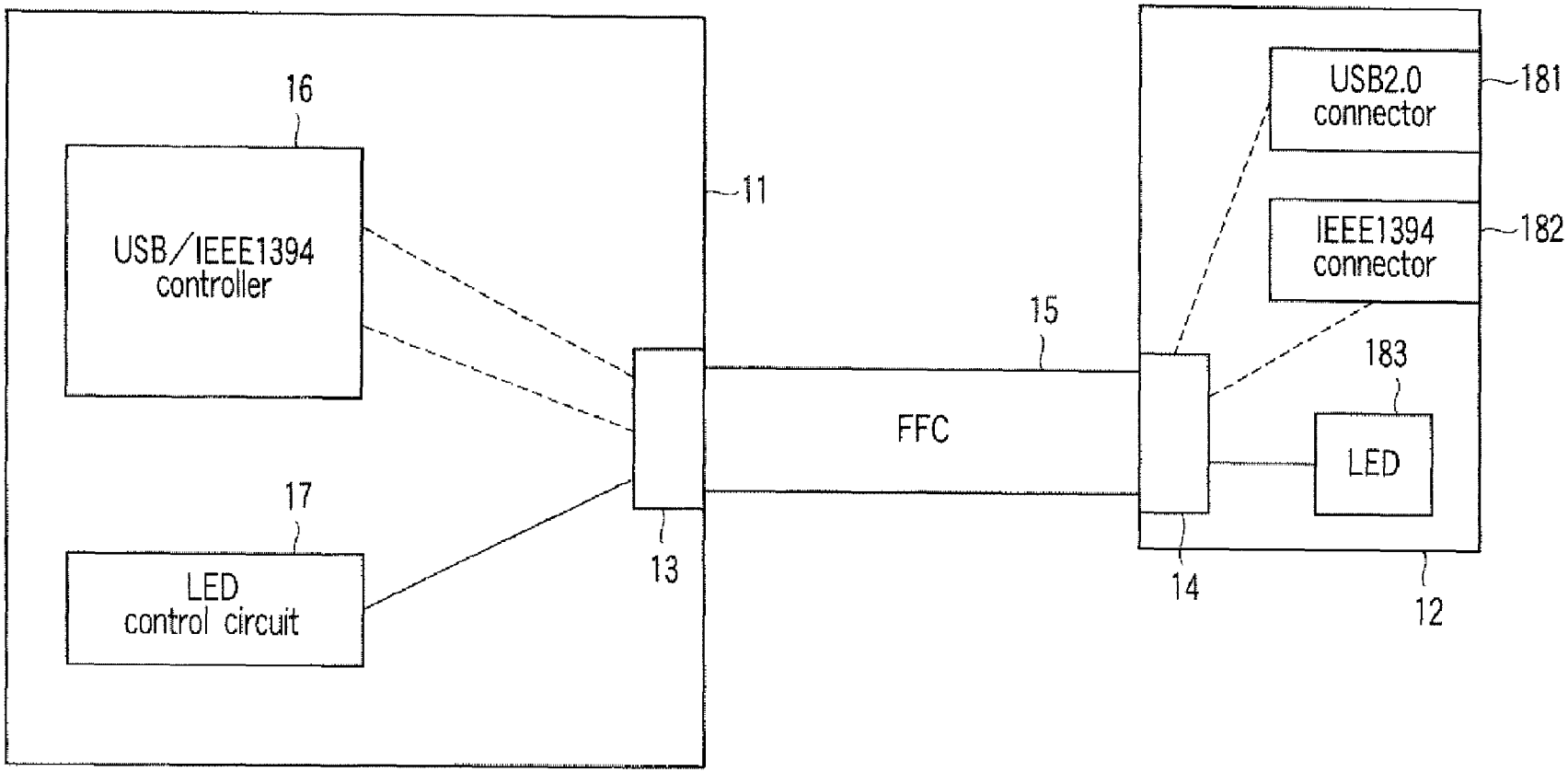
FIG. 11 is an exemplary block diagram showing an example of concrete structures of the two electronic components which are provided in the electronic apparatus shown in FIG. 1.

FIG. 11 shows an example of the concrete structure of each of the electronic components 11 and 12.

A USB/IEEE1394 controller is mounted as the above-described electronic device 16 on the printed circuit board of the electronic component 11. The USB/IEEE1394 controller 16 and the connector 13 are connected by high-speed transmission lines which are provided on the printed circuit board. In this example, a differential signal line pair is used as the high-speed transmission lines. Further, a light emitting diode (LED) control circuit is mounted as the above-described electronic device 17 on the printed circuit board of the electronic component 11. The LED control circuit 17 is connected to the connector 13 over a signal line which is provided on the printed circuit board.

A USB 2.0 external connector 181 and an IEEE1394 external connector 182, which function as the above-described external connectors, are mounted on the printed circuit board of the electronic component 12. Each of the USB 2.0 external connector 181 and IEEE1394 external connector 182 and the connector 14 are connected by a differential signal line pair which is provided on the printed circuit board. Communication with an external USB device, which is connected to the USB 2.0 external connector 181 via a cable, is executed by the USB/IEEE1394 controller 16. Communication with an external IEEE1394 device, which is connected to the IEEE1394 external connector 182 over a cable, is also executed by the USB/IEEE1394 controller 16.

Further, an LED 183 for visual indication of operation state of the electronic apparatus 10 is mounted on the printed circuit board of the electronic component 12. The LED 183 is connected to the connector 14 via a signal line which is provided on the printed circuit board. Control of the LED 183 is executed by the LED control circuit 17.

The flexible flat cable 15 is used for connection between the electronic component 11 and electronic component 12. As has been described above, the flexible flat cable 15 is provided with the shield layer (GND shield) 114 in order to compensate the GND reference deficiency for high-speed signal transmission. In addition, in order to decrease impedance between each ground line and the shield layer (GND shield) 114, each ground line is connected to the shield layer (GND shield) 114 via a connection line (a pair of connection line members) which is called "drain line".

Figure 12:
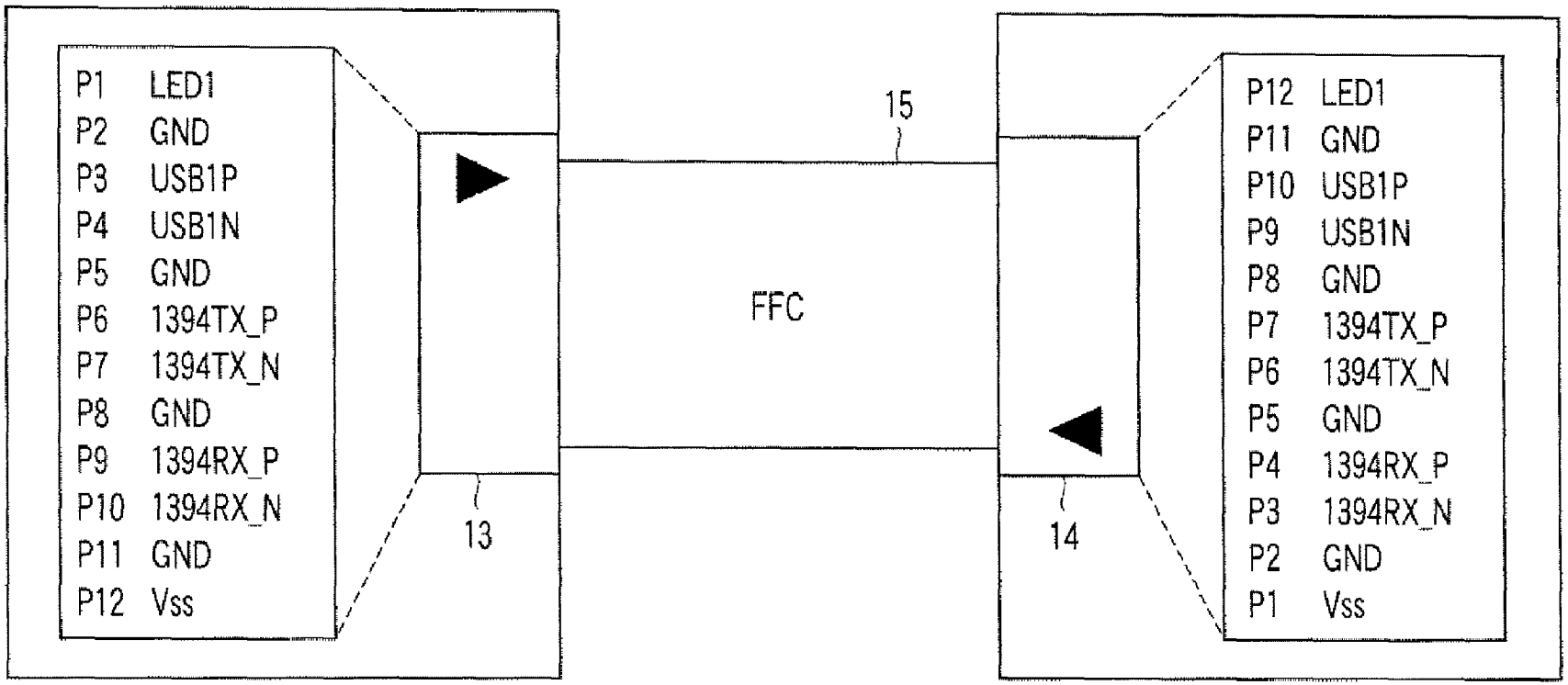
FIG. 12 shows an example of pin assign of two connectors which are provide in the two electronic components shown in FIG. 11, respectively.

FIG. 12 shows an example of pin assign, which is applied to each of the connectors 13 and 14.

A signal (LED1) for controlling the LED 183 is assigned to the terminal P1 of the connector 13. The signal (LED1) is sent from the LED control circuit 17 to the LED 183 via the connector 13, flexible flat cable 15 and connector 14. The terminals P2, P5, P8 and P11 of the connector 13 are ground terminals for high-speed signal transmission and are grounded.

A pair of USB differential signals (USB1P, USB1N) are assigned to the two neighboring terminals P3 and P4. The pair of USB differential signals (USB1P, USB1N) are differential signals which are bidirectionally transmitted between the USB/IEEE1394 controller 16 and the external USB device.

A pair of IEEE1394 differential signals (1394TX_P, 1394TX_N) are assigned to the two neighboring terminals P6 and P7. The pair of IEEE1394 differential signals (1394TX_P, 1394TX_N) are differential signals which are sent from the USB/IEEE1394 controller 16 to the external IEEE1394 device. A pair of IEEE1394 differential signals (1394RX_P, 1394RX_N) are assigned to the two neighboring terminals P9 and P10. The pair of IEEE1394 differential signals (1394RX_P, 1394RX_N) are differential signals which are sent from the external IEEE1394 device to the USB/IEEE1394 controller 16. A ground potential VSS is assigned to the terminal P12, The ground potential VSS is supplied as a reference potential from the electronic component 11 to the electronic component 12.

A positive power supply potential VCC, in place of the signal (LED1), may be assigned to the terminal P1, and the positive power supply potential VCC and the ground potential VSS may be supplied as power to the external USB device, etc.

Figure 13:
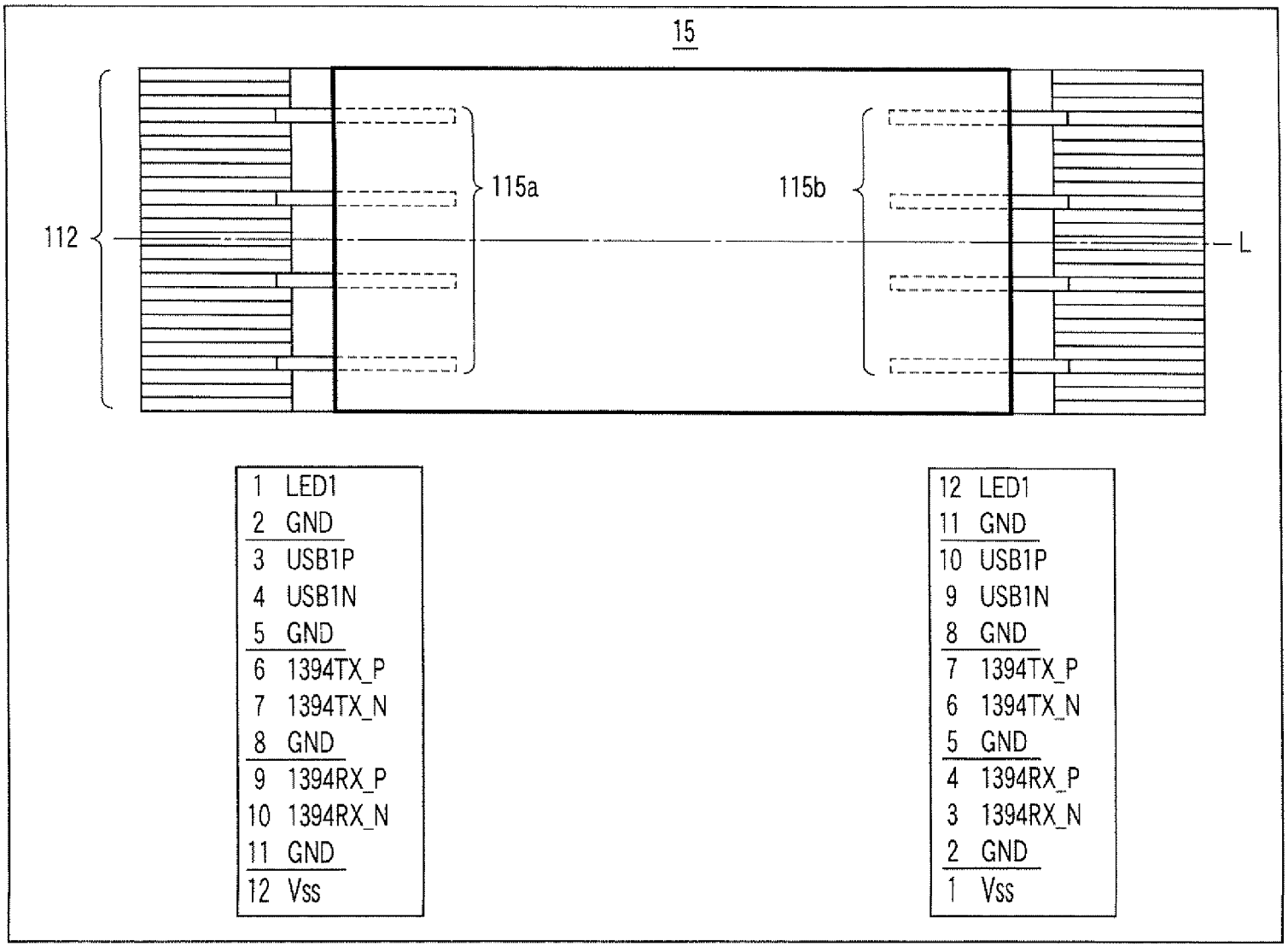
FIG. 13 shows an example of conductor assign of the flexible flat cable, which corresponds to the pin assign shown in FIG. 12.

FIG. 13 shows an example of conductor assign of the flexible flat cable 15, which corresponds to the pin assign shown in FIG. 12. As has been described above, the flexible flat cable 15 has the same number of conductors as the number of terminals (pins) of the connector 13, 14. The conductors of the flexible flat cable 15, which correspond to the terminals of the connector 13, 14 that are designated as GND terminals, are connected to the shield layer by the associated connection lines (drain lines GND). Since the shield layer and the ground terminals (GND) in the connector 13, 14 are connected by this structure, high-speed signal transmission characteristics can be obtained. Thus, no drain line GND is needed for transmission of an ordinary ground potential VSS, which is not used for enhancement in high-speed transmission characteristics.

Figure 15:
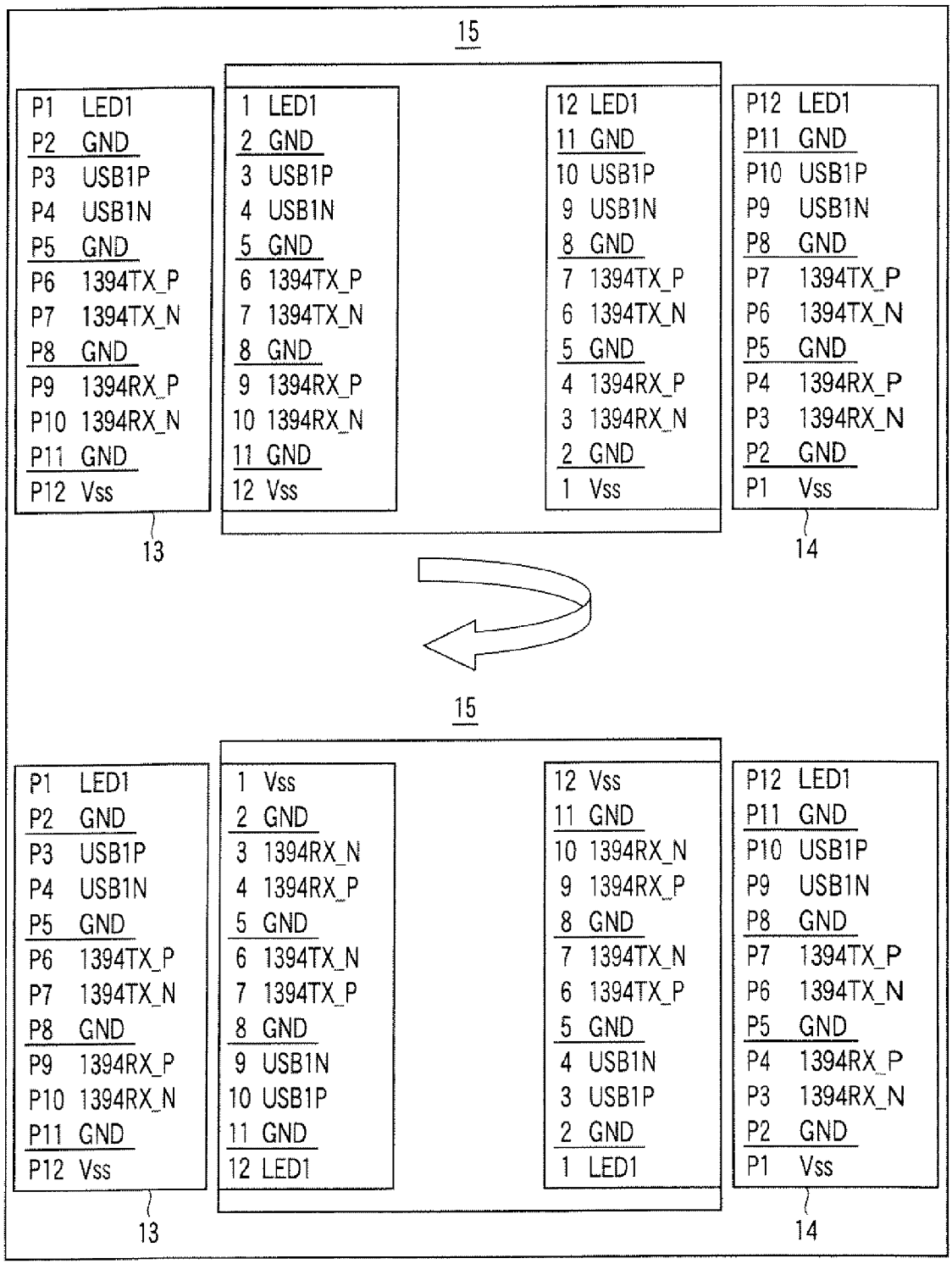
FIG. 15 is an exemplary view for explaining the relationship between the pin assign shown in FIG. 12 and the conductor assign shown in FIG. 13.
Figure 16:
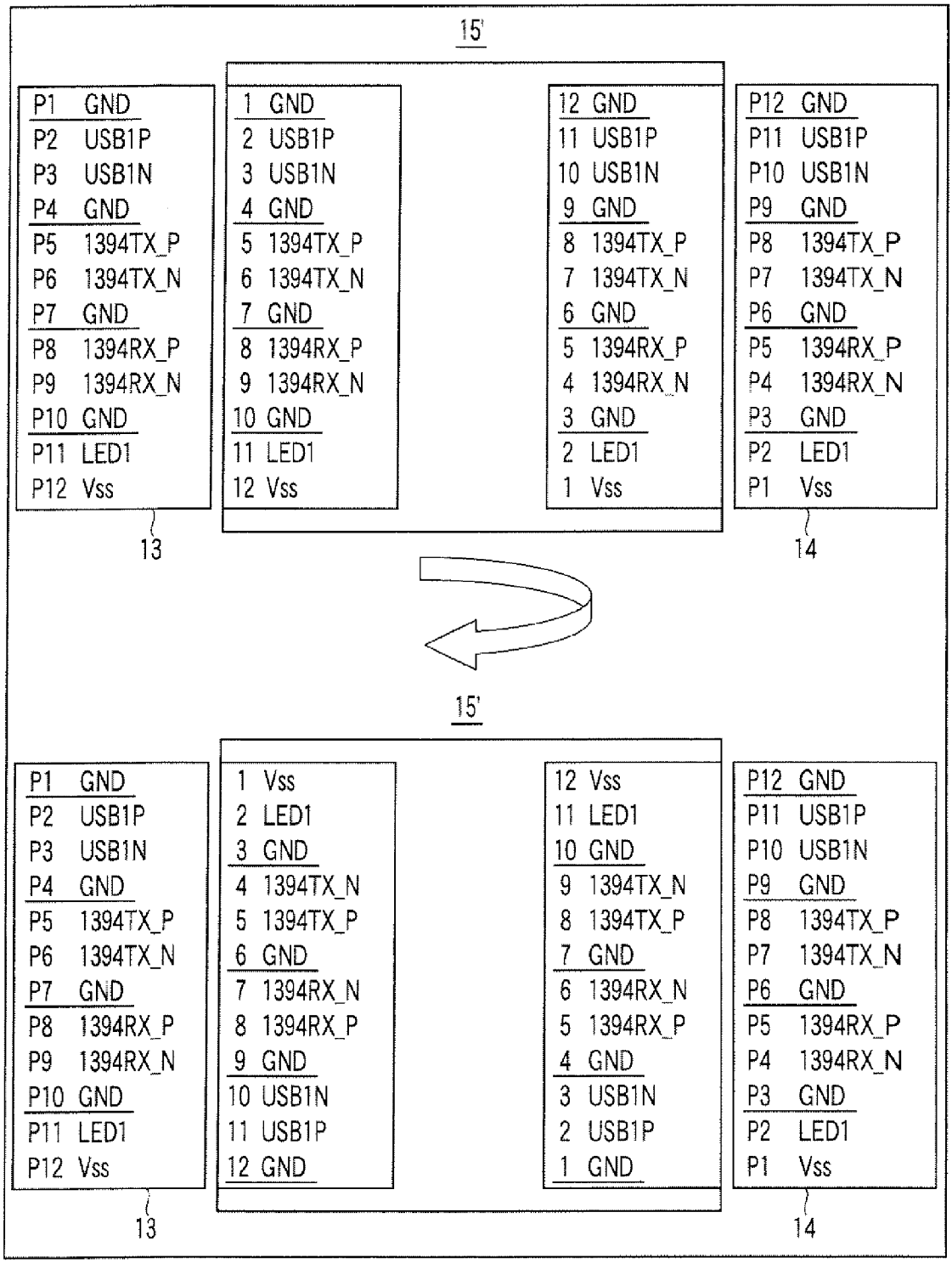
FIG. 16 is an exemplary view for explaining the relationship between the pin assign shown in FIG. 12 and the conductor assign shown in FIG. 14.

Now consider a case in which the flexible flat cable 15 is disposed in the state in which the flexible flat cable 15 is turned over 180° (i.e. reversed from right to left). In the case of a normal connection method, the pin assign of the connector 13, 14 and the conductor assign of the flexible flat cable 15 have a relationship as shown in an upper part of FIG. 15. On the other hand, in the case where the flexible flat cable 15 is turned over 180°, the pin assign and the conductor assign have a relationship as shown in a lower part of FIG. 15. As is understood, although the assignment of signals to the signal lines in the flexible flat cable 15 varies between the normal connection time and the time when the flexible flat cable 15 is turned over 180°, the positional relationship between the drain lines (i.e., grand lines GND) and the signal lines is unchanged. Since the signal lines are the same electrical conductors, no fault occurs in operation even if the assignment of signals to the signal lines is changed.

Figure 14:
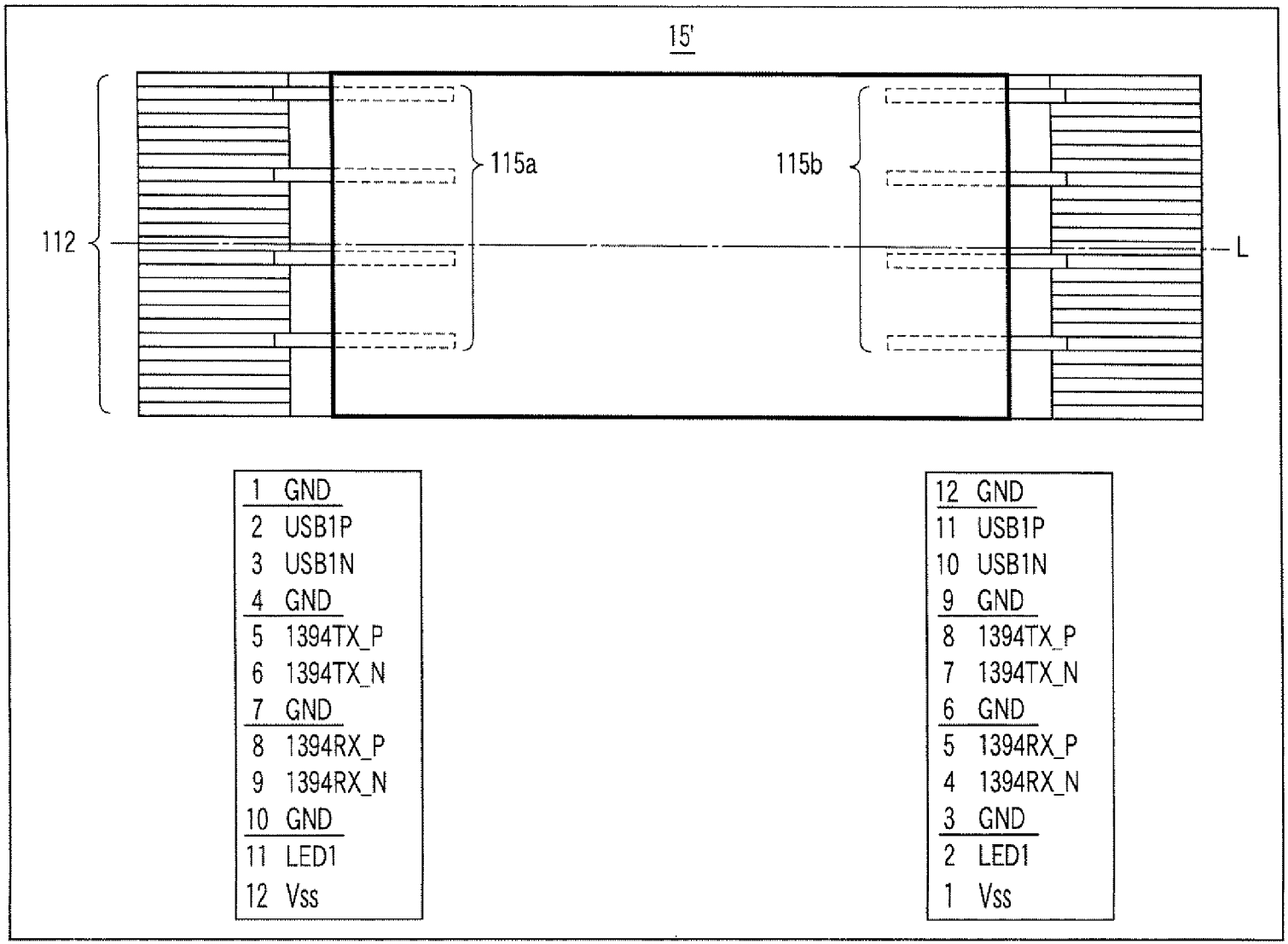
FIG. 14 shows an example of conductor assign of a flexible flat cable.

If use is made of a flexible flat cable 15' in which drain lines GND are disposed as shown in FIG. 14, the positional relationship between the drain lines (GND) and the signal lines would be changed between the normal connection time and the time when the flexible flat cable 15' is turned over 180°, and signals would be applied to the drain lines (GND). In this case, signals cannot normally be transmitted. In some cases, a positive power supply potential and a ground are short-circuited, leading to danger such as burning.

Figure 17:
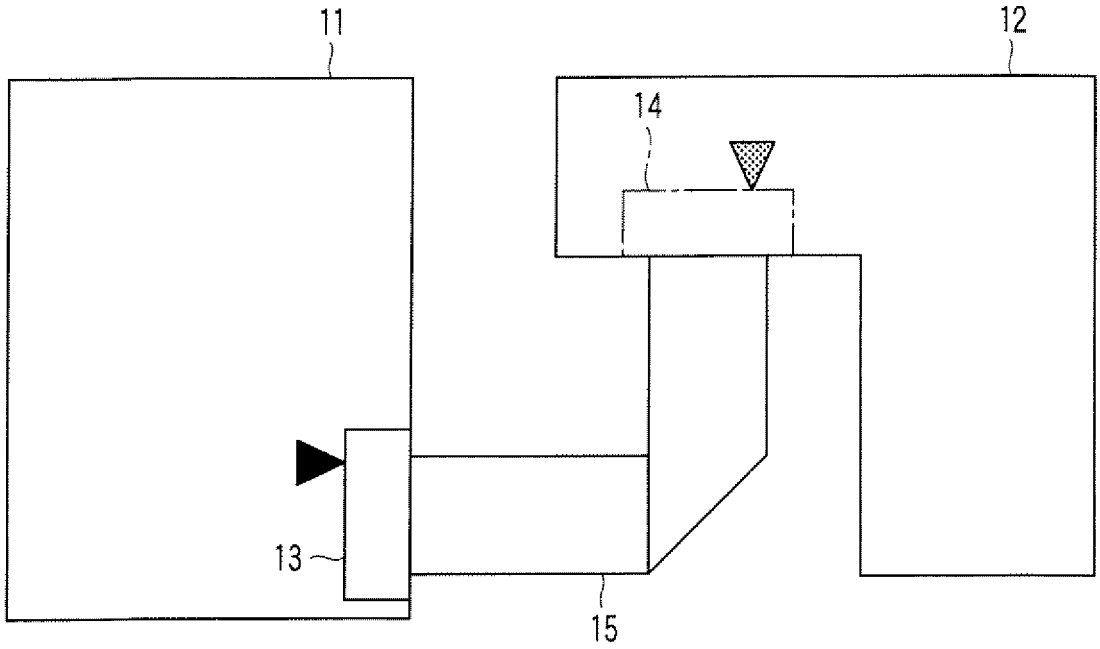
FIG. 17 shows a state in which the flexible flat cable, which is applied to the electronic apparatus shown in FIG. 1, is used in a bent form.

FIG. 17 shows a state in which the connectors 13 and 14 are coupled by using a flexible flat cable 15 which is bent. In this case, too, no matter which of one end portion and the other end portion of the flexible flat cable 15 is connected to which of the two connectors 13 and 14, the first electronic component 11 and second electronic component 12 can normally be connected via the flexible flat cable 15.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An electronic apparatus comprising:

a flexible flat cable which interconnects a first electronic component and a second electronic component, the flexible flat cable including a first insulation layer, a plurality of signal lines and a plurality of ground lines which are disposed in parallel on the first insulation layer, a second insulation layer which is provided on the plurality of signal lines and the plurality of ground lines in such a manner as to expose both end portions of the plurality of signal lines and the plurality of ground lines, an electromagnetic shield layer provided on the second insulation layer, and a plurality of connection lines which electrically connect the plurality of ground lines and the electromagnetic shield layer, each of the plurality of connection lines including a first connection line member which extends from one end portion of the associated ground line and is held between the second insulation layer and the electromagnetic shield layer, and a second connection line member which extends from the other end portion of the associated ground line and is held between the second insulation layer and the electromagnetic shield layer, an arrangement of the signal lines and the ground lines that are positioned on one side of a center line of the flexible flat cable, which is parallel to a longitudinal direction of the flexible flat cable, and an arrangement of the signal lines and the ground lines that are positioned on the other side of the center line being symmetric with respect to the center line; and a first connector and a second connector which are provided in the first electronic component and the second electronic component, respectively, and are connected to one end portion and the other end portion of the flexible flat cable, respectively, each of the first and second connectors including a plurality of signal terminals corresponding to the plurality of signal lines and a plurality of ground terminals corresponding to the plurality of ground lines, each of the plurality of ground terminals being grounded, at least one signal terminal of the plurality of signal terminals, which is interposed between two neighboring ones of the plurality of ground terminals, being assigned a signal which is to be transmitted from one of the first and second electronic components to the other, and at least one other signal terminal of the plurality of signal terminals being assigned a ground potential that is a reference signal which is to be transmitted from one of the first and second electronic components to the other.

2. The electronic apparatus according to claim 1, wherein the signal which is to be transmitted from one of the first and second electronic components to the other is a pair of differential signals.

3. The electronic apparatus according to claim 1, wherein the signal which is to be transmitted from one of the first and second electronic components to the other is a single end signal.

4. The electronic apparatus according to claim 1, wherein the signal which is to be transmitted between the first and second electronic components is a pair of differential signals, a total number of the plurality of signal lines and the plurality of ground lines in the flexible flat cable is an even number, the plurality of signal lines include two signal lines which neighbor with the center line of the flexible flat cable being interposed, and the plurality of ground lines include first and second ground lines which are disposed on both sides of the two signal lines; and two signal terminals of the plurality of signal terminals, which correspond to the two signal lines, are assigned the pair of differential signals.

5. The electronic apparatus according to claim 1, wherein the signal which is to be transmitted between the first and second electronic components is a pair of first differential signals and a pair of second differential signals;

a total number of the plurality of signal lines and the plurality of ground lines in the flexible flat cable is an odd number, a first ground line is disposed on the center line, a first signal line, a second signal line and a second ground line are successively arranged from the center line toward said one side, and a third signal line, a fourth signal line and a third ground line are successively arranged from the center line toward said other side; and two signal terminals of the plurality of signal terminals, which correspond to the first and second signal lines, are assigned the pair of first differential signals, and two signal terminals of the plurality of signal terminals, which correspond to the third and fourth signal lines, are assigned the pair of second differential signals.

6. The electronic apparatus according to claim 1, wherein the signal which is to be transmitted between the first and second electronic components is a pair of first differential signals and a pair of second differential signals;

a total number of the plurality of signal lines and the plurality of ground lines in the flexible flat cable is an even number, a first ground line, a first signal line, a second signal line and a second ground line are successively arranged from the center line toward said one side, and a third ground line, a third signal line, a fourth signal line and a fourth ground line are successively arranged from the center line toward said other side; and two signal terminals of the plurality of signal terminals, which correspond to the first and second signal lines, are assigned the pair of first differential signals, and two signal terminals of the plurality of signal terminals, which correspond to the third and fourth signal lines, are assigned the pair of second differential signals.

7. The electronic apparatus according to claim 1, wherein the first electronic component includes a first printed circuit board on which the first connector is provided, and an electronic device which is provided on the first printed circuit board and sends the signal to the second electronic component via the first connector and the flexible flat cable, and each of the plurality of ground terminals of the first connector is electrically connected to a ground terminal on the first printed circuit board.

8. The electronic apparatus according to claim 7, wherein the second electronic component includes a second printed circuit board on which the second connector is provided, and an external connector which is provided on the second printed circuit board and sends the signal, which is received from the first electronic component via the flexible flat cable and the second connector, to an external device via a cable, and each of the plurality of ground terminals of the second connector is electrically connected to a ground terminal on the second printed circuit board.

9. The electronic apparatus according to claim 1, wherein the electromagnetic shield layer includes an electrically conductive layer.

* * * * *